US006994522B1

(12) United States Patent
Chin-Chih et al.

(10) Patent No.: US 6,994,522 B1
(45) Date of Patent: Feb. 7, 2006

(54) FAN BLADE

(76) Inventors: Chang Chin-Chih, P.O. Box 2-10, Tainan City (TW); Huang Chen-Lung, P.O. Box 2-10, Tainan City (TW)

( * ) Notice: Subject to any disclaimer, the term of this patent is extended or adjusted under 35 U.S.C. 154(b) by 392 days.

(21) Appl. No.: 10/205,730

(22) Filed: Jul. 17, 2002

(51) Int. Cl.
*F04O 29/70* (2006.01)

(52) U.S. Cl. ..... 416/146 R; 416/62; 416/234; 55/467; 55/471; 55/490; 95/277; 422/124

(58) Field of Classification Search ..... 416/5, 416/62, 146 R, 234; 55/467, 471, 400, 490; 95/277; 422/124
See application file for complete search history.

(56) References Cited

U.S. PATENT DOCUMENTS 4,753,573 A * 6/1988 McKnight ..... 416/62
5,341,565 A * 8/1994 Kuryliw ..... 416/5
5,370,721 A * 12/1994 Carnahan ..... 416/62
5,422,078 A * 6/1995 Colon ..... 422/124
5,562,412 A * 10/1996 Antonelli ..... 416/62
6,485,538 B1 * 11/2002 Toyoshima ..... 55/490
6,733,239 B2 * 5/2004 Lee ..... 416/62

* cited by examiner

*Primary Examiner*—Christopher Verdier

(57) ABSTRACT

A fan blade includes a shaft base and plural wind guiders formed integral with the shaft base. The wind guiders are fixed spaced apart equidistantly on the peripheral edge of the shaft base. Each wind guider is formed integral with one or more than one netted portions, and each netted portion is fixed with non-woven cloth having sticky material fixed thereon. The sticky surface of the non-woven cloth is applied with activated carbon, or fragrant material able to give out fragrance or material able to remove bad smell in air. The fan blade has functions of filtering dust in air and giving out fragrance.

9 Claims, 7 Drawing Sheets

FAN BLADE

BACKGROUND OF THE INVENTION

This invention relates to a fan blade, particularly to one able to filter dust, eliminate bad smell in air, and produce fragrance.

The fan blade 1 of a conventional stand electric fan, as shown in FIG. 1 disclosed in a Taiwan patent No. 431563, includes a shaft base 10 and plural wind guiders 12 formed integral. The wind guiders 12 are radially positioned spaced apart equidistantly on the peripheral edge of the shaft base 10. Each wind guider 12 is formed integral with a center hollow space 13 having its peripheral edge 130 provided with a plurality of fasteners 131 (female ones or male ones or Vecro bands). A filtering member 14 has its peripheral edge 140 provided with a plurality of fasteners 141 (female ones or male ones, or Vecro bands) for correspondingly combining with the fasteners 131 of the wind guider 12 so as to fixedly fit the filtering members 14 on the recessed hollow 13 of the wind guiders 12 for filtering.

However, the conventional fan blade needs to be provided with numerous fasteners 131 for respectively combining with the fasteners 141 of the filtering members 14, thus increasing weight of the fan blade and rendering the motor of an electric fan consuming much electricity. Besides, the metallic or plastic fasteners 131 provided on the wind guider 12 have to be respectively fixed at a proper position calculated precisely so as not to unbalance the wind guiders 12 when they are rotating, thus increasing difficulty in manufacturing, lowering proportion of qualified products and elevating producing cost.

The fan blade 2 of a conventional ceiling fan, as shown in FIG. 2 disclosed in a Taiwan patent No. 463885, has its wind guiders 20 respectively made of an upper blade 200 and a lower blade 201. The upper and the lower blades 200, 201 are respectively formed with a number of holes 202 and 203 in the surface and provided with a plurality of clasps 204 and clasping grooves 205 on opposite sides. Then, a filtering member 21 is sandwiched between the upper and the lower blade 200 and 201 for filtering dust in air.

However, the wind guiders 20 respectively made of the upper blade and the lower blade 200, 201 are only applicable to a ceiling fan. For one thing, the fan blade of a ceiling fan rotates much slower than that of a stand electric fan; for another, rotating angles of most ceiling fans can be adjusted manually, while the fan blade of a stand electric fan is formed integral and rotates at a high speed, therefore in case unbalance of rotating should happen, such a fan blade can hardly be adjusted in angles.

SUMMARY OF THE INVENTION

This invention is devised to offer a fan blade having functions of filtering dust in air, producing pure subtle fragrance and eliminating bad smell in air.

The features of the invention are as follows:

1. The fan blade is formed integral with plural wind guiders respectively formed with one or more than one netted portion of any shapes.

2. The netted portion of each wind guider of the fan blade is fixed with non-woven cloth having its surface applied with sticky material and its sticky surface is applied with filtering material such as activated carbon or fragrant material or material able to remove bad smell in air.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
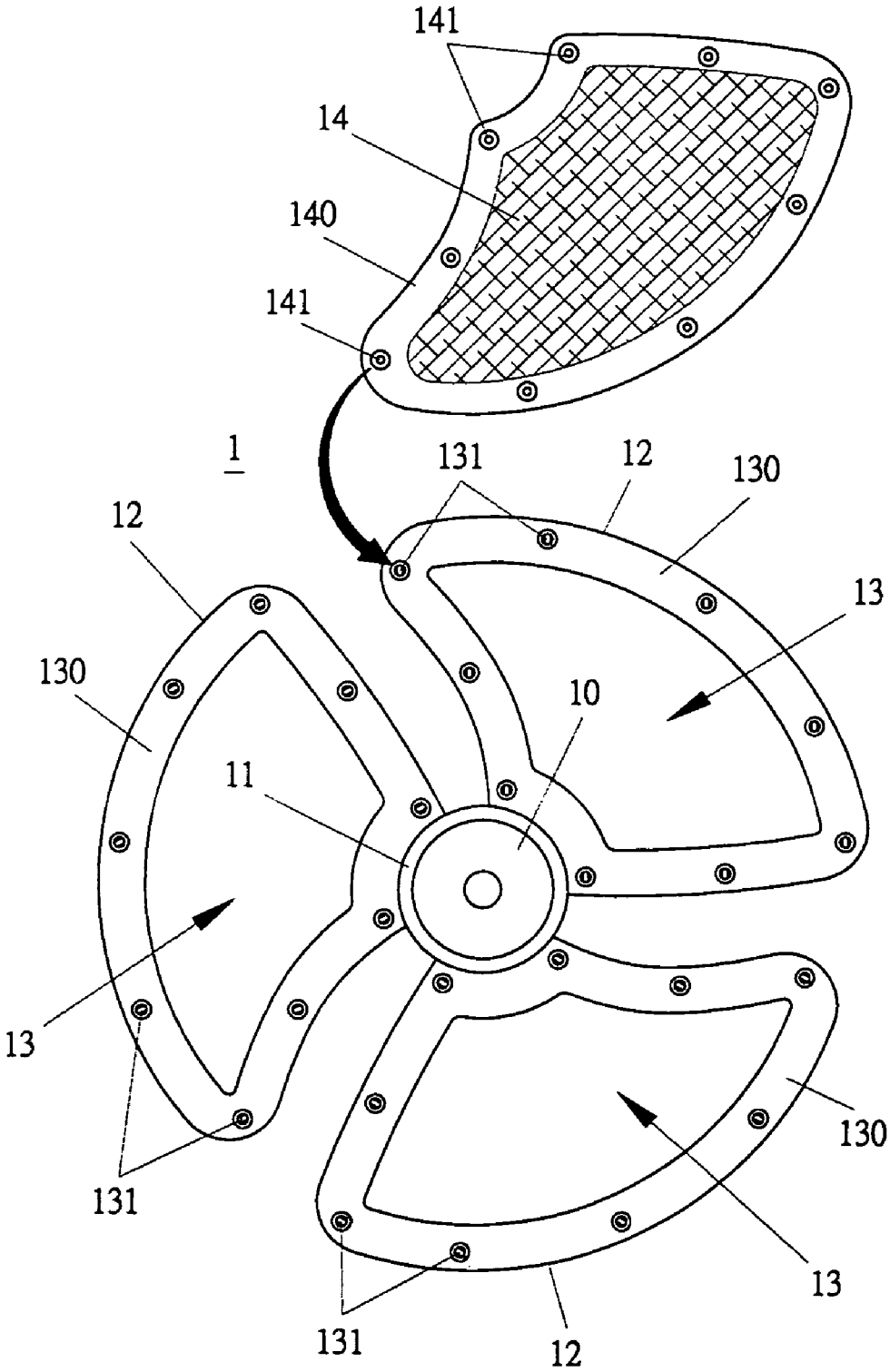
FIG 1 (PRIOR ART)
FIG. 1 is an exploded perspective view of a fan blade of a conventional stand electric
Figure 2:
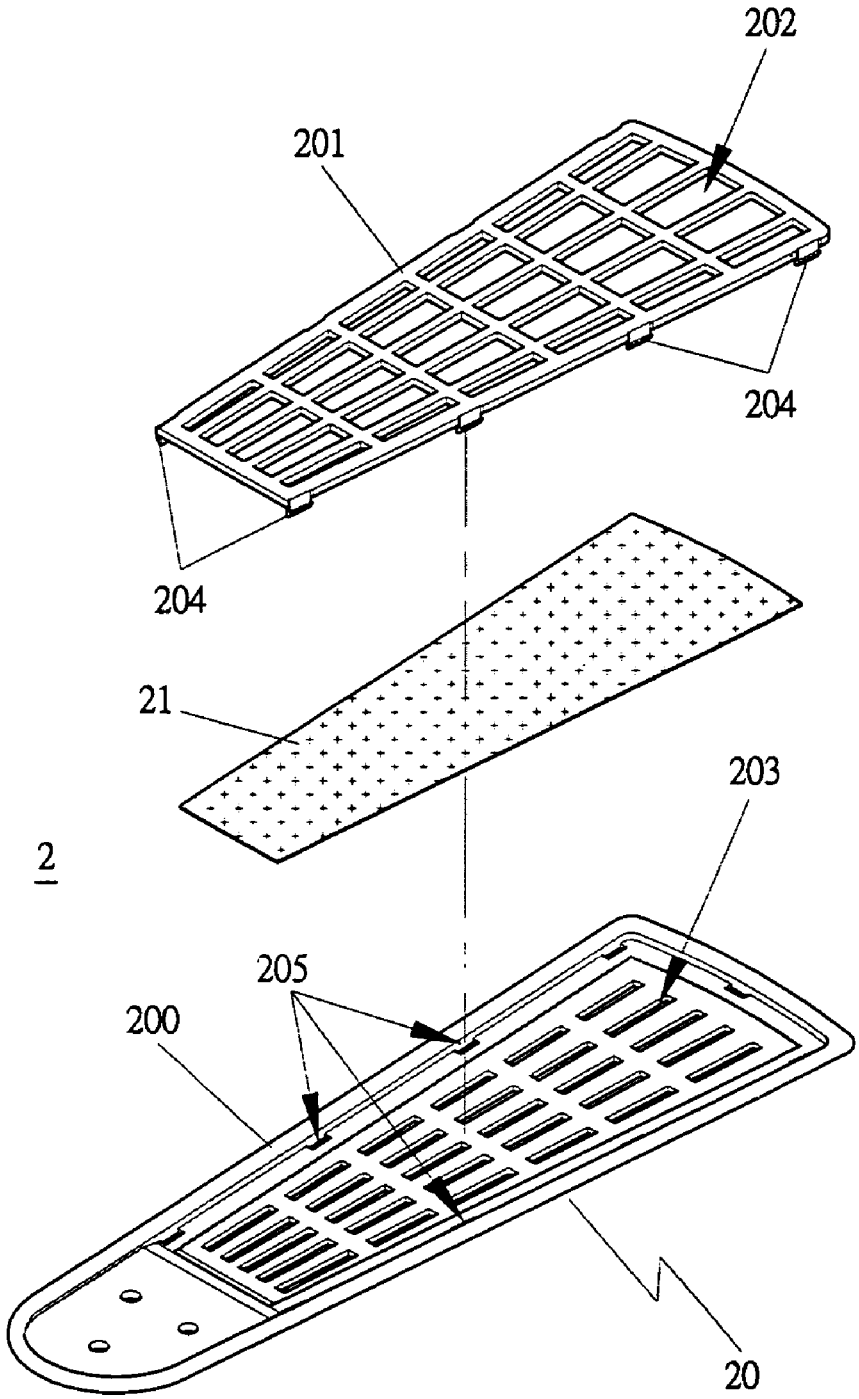
FIG 2 (PRIOR ART)
FIG. 2 is an exploded perspective view of a fan blade of a conventional ceiling fan.
Figure 3:
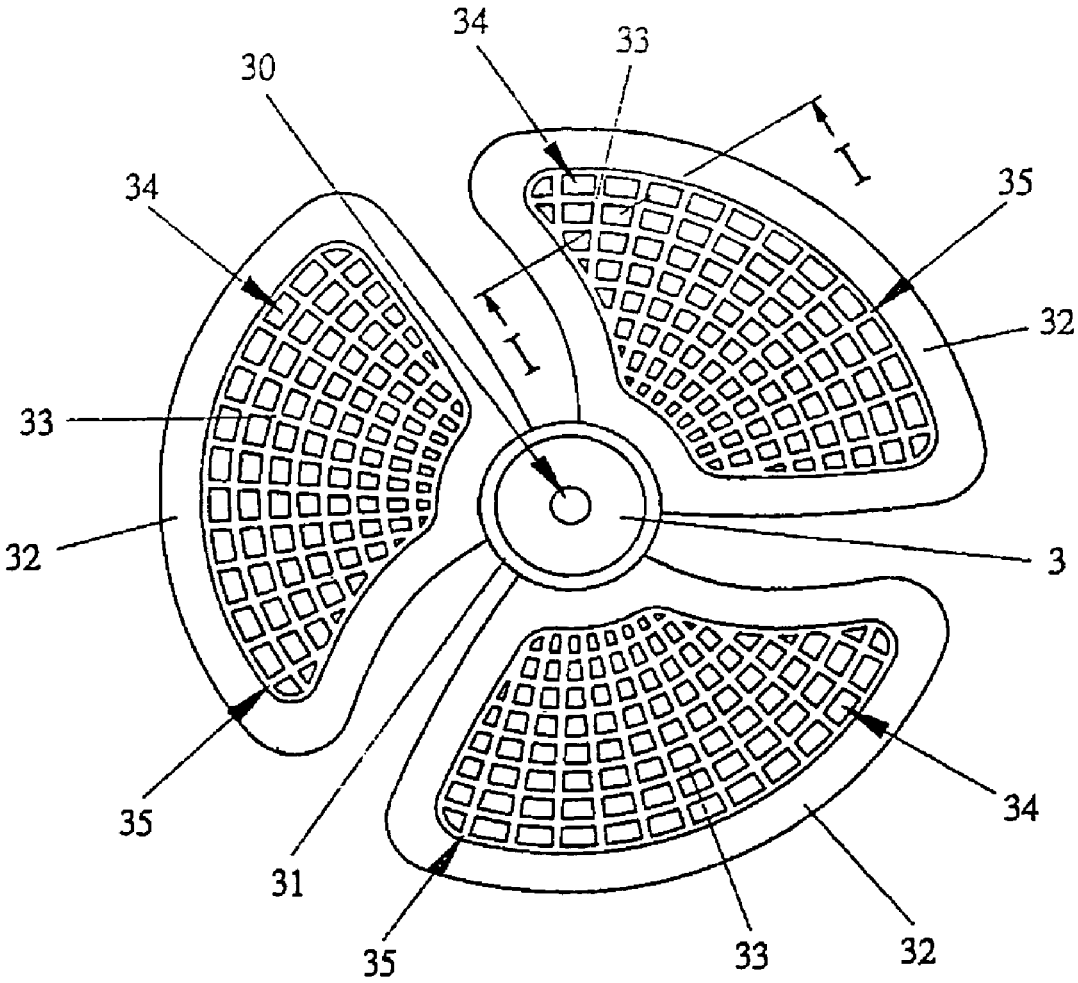
FIG. 3 is a rear view of a fan blade provided with no filtering member in the present invention.
Figure 4:
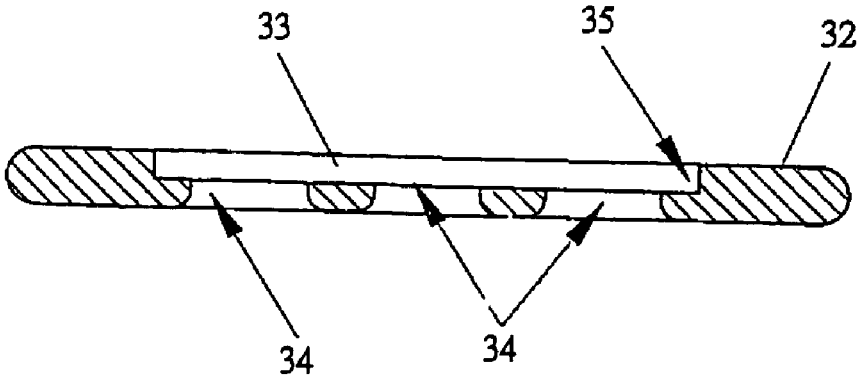
FIG. 4 is a cross-sectional view of the line I—I in FIG. 3.

A preferred embodiment of a fan blade in the present invention, as shown in FIGS. 3 and 4, includes a shaft base 3 and plural wind guiders 32 formed integral.

The shaft base 3 is bored with a center hole 30 for receiving the spindle of a motor to rotate the fan blade. The shaft base 3 has it circumferential edge 31 fixed with plural wind guiders 32, the number of which depends on practical needs (more than two preferably).

Each wind guider 32 is formed integral with a netted portion 33 having numerous dense net holes 34 in the surface. The net hole 34 is square-shaped or round-shaped or the like so long as a current of air can pass therethrough.

Figure 7:
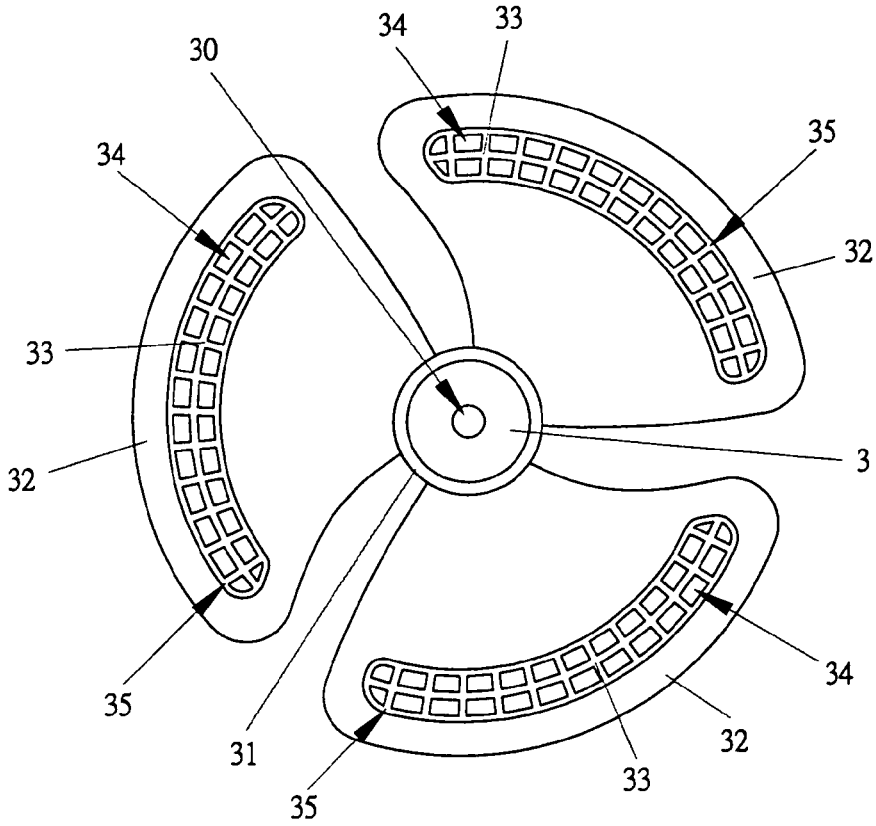
FIG. 7 is a front view of the fan blade, illustrating that each wind guider is formed with only one netted portion in the present invention.
Figure 8:
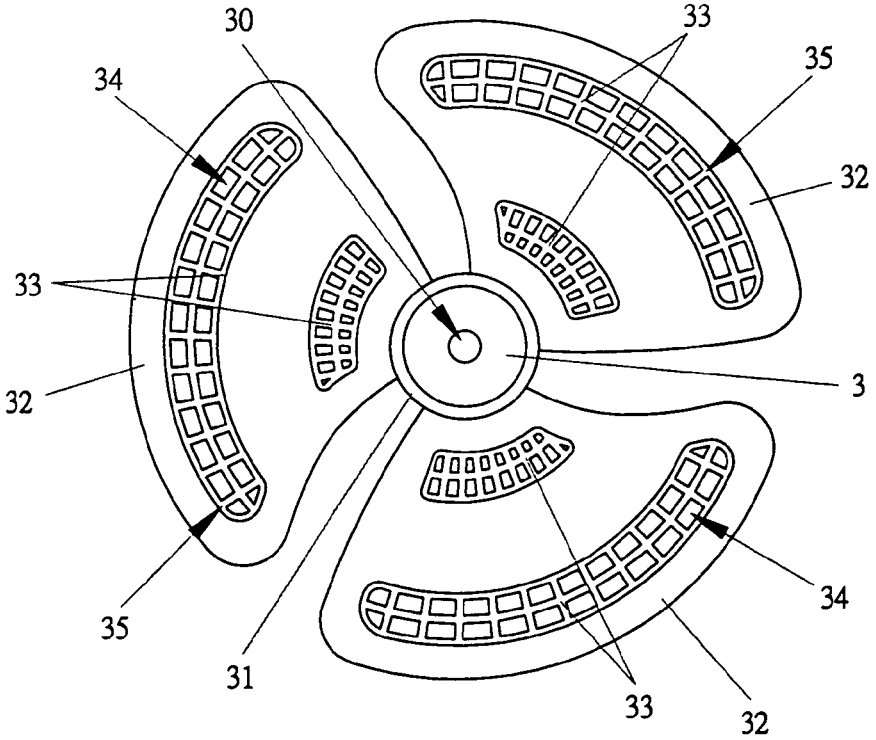
FIG. 8 is a front view of the fan blade, illustrating that each wind guider is formed with two netted portions in the present invention.
Figure 9:
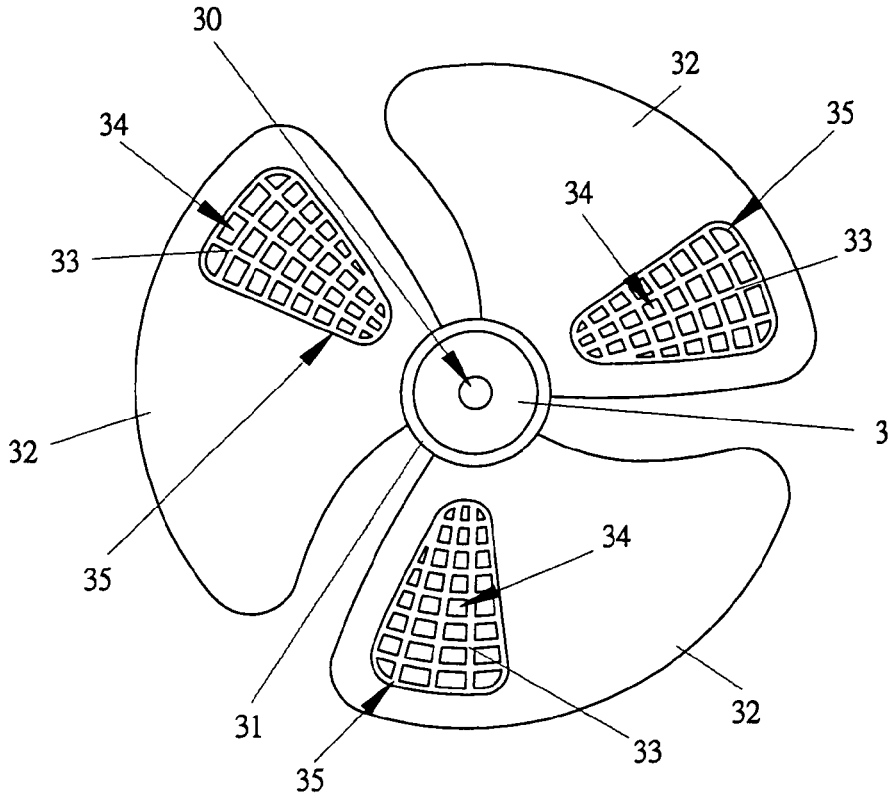
FIG. 9 is a front view of the fan blade having each wind guider formed with a sector-shaped netted portion in the present, invention.
Figure 10:
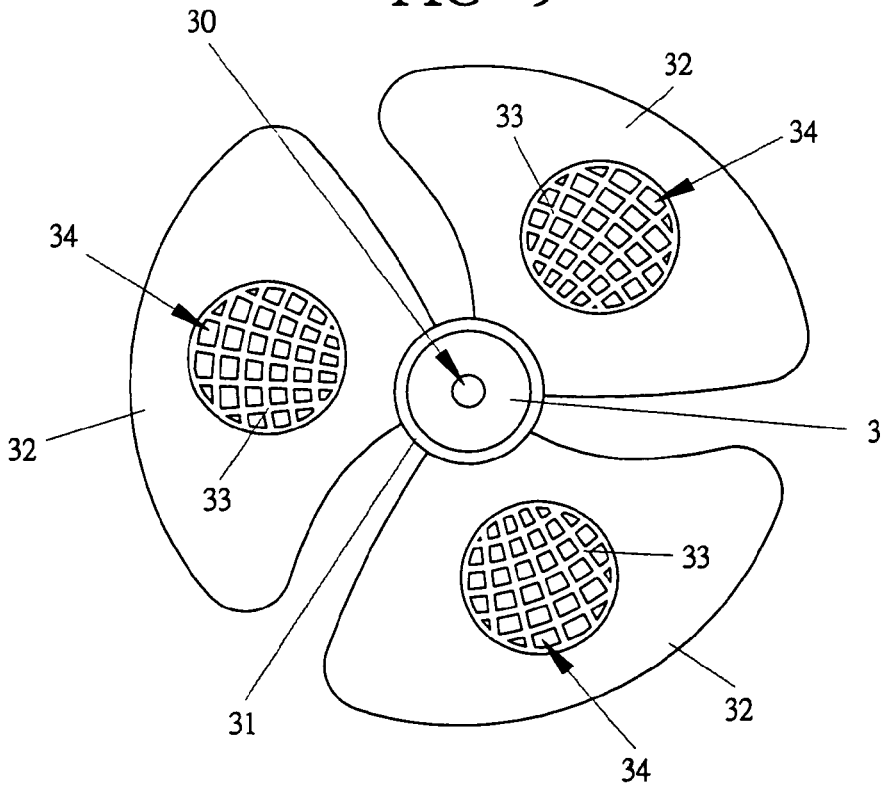
FIG. 10 is a front view of the fan blade having each wind guider formed with a round-shaped netted portion in the present invention.
Figure 11:
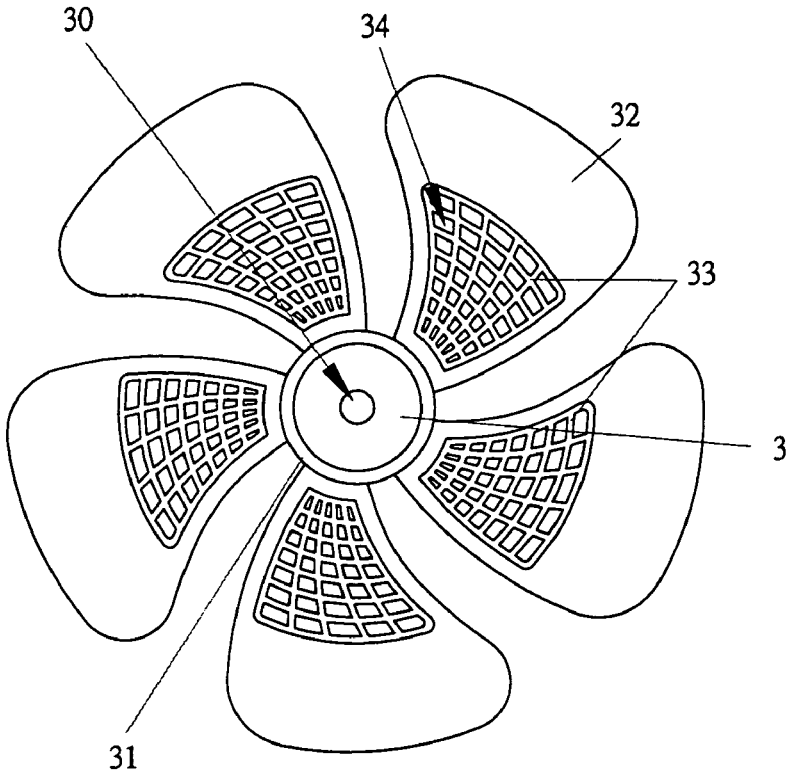
FIG. 11 is a front view of the fan blade having each wind guider formed with a sector-shaped netted portion in the present invention.
Figure 12:
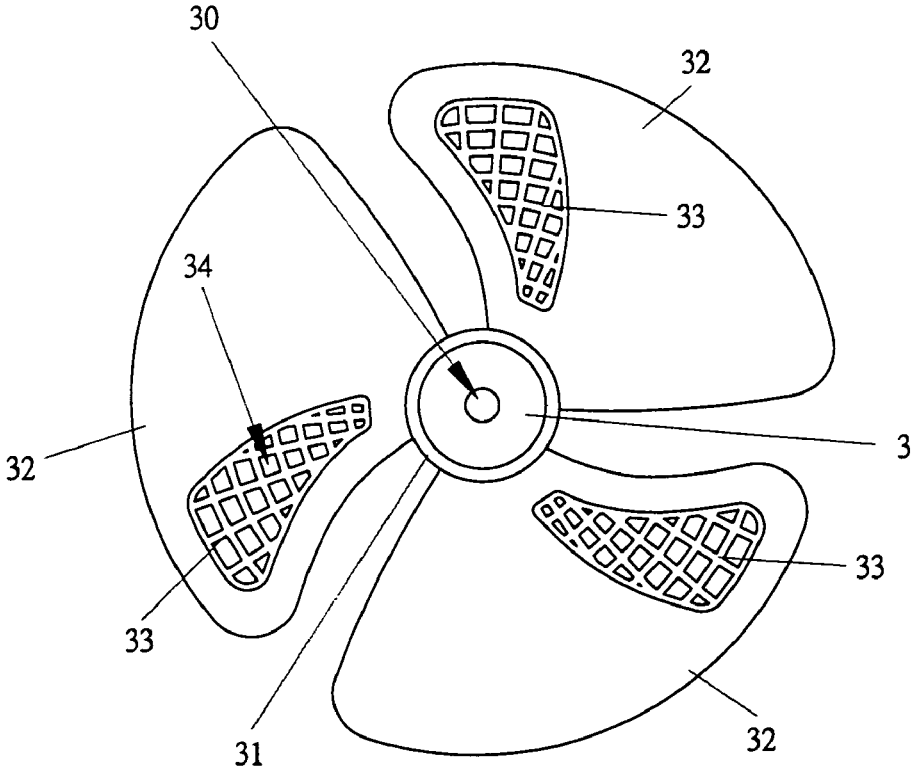
FIG. 12 is a front view of the fan blade having each wind guider formed with a sector-shaped netted portion in the present invention.

Each wind guider 32 is formed with only one netted portion 33, as shown in FIGS. 7, 9, 10, 11 and 12, or with more than one netted portions 33, as shown in FIG. 8, depending on practical needs. Besides, the netted portion 33 could be of any shapes, such as sector, as shown in FIGS. 3, 9, 11 and 12, or round, as shown in FIG. 10, or oval, as shown in FIGS. 7 and 8, or the like, so long as a current of air can pass through its net holes 34.

Figure 5:
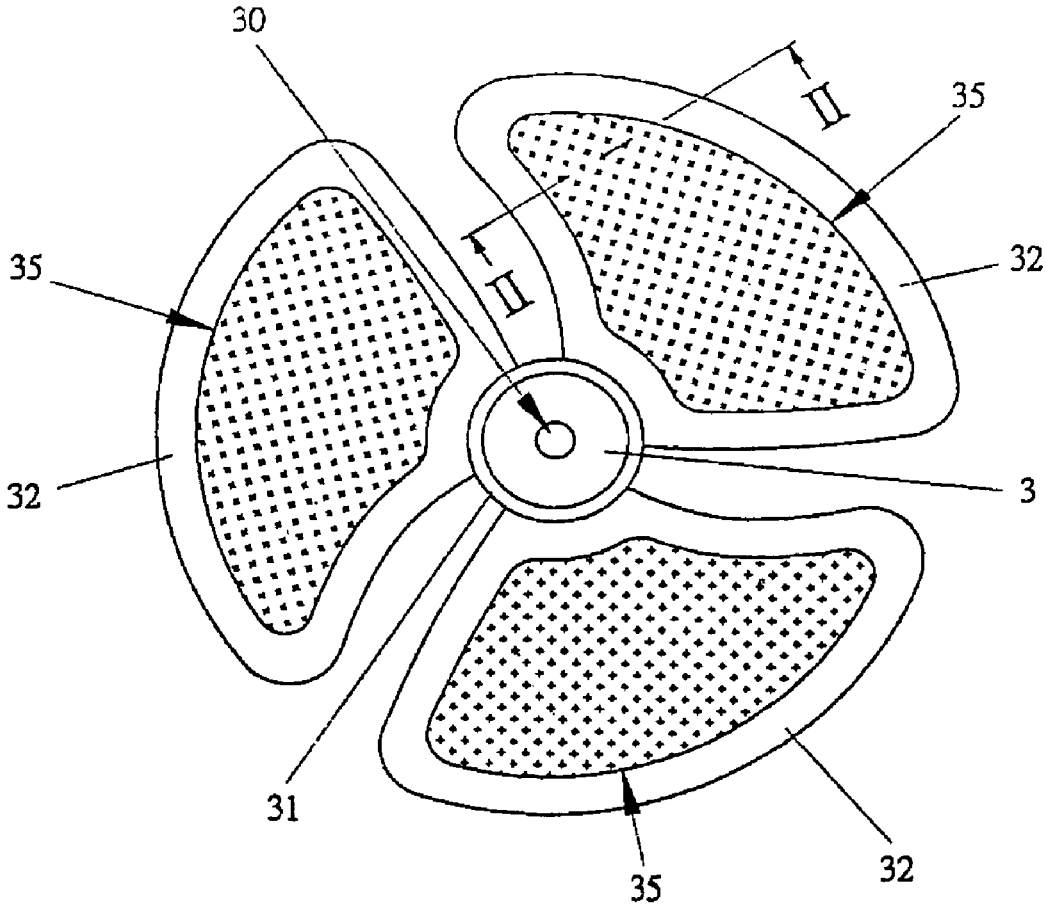
FIG. 5 is a rear view of the fan blade provided with a filtering member in the present invention.
Figure 6:
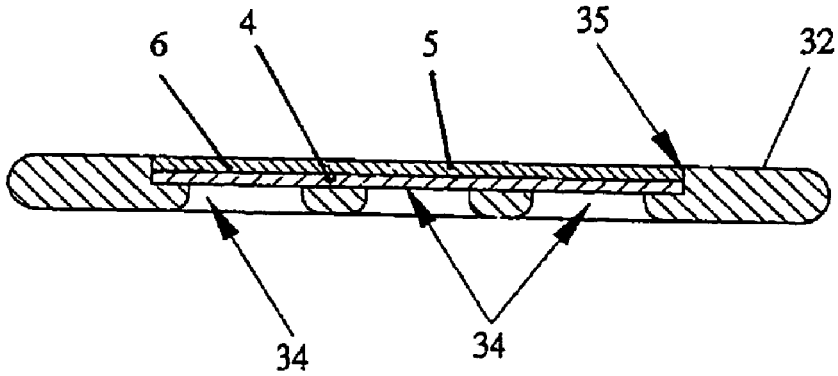
FIG. 6 is a cross-sectional view of the line II—II in FIG. 5.

In addition, each netted portion 33 is formed with a recessed groove 35 crossing in the surface for fixing non-woven cloth 4 therein. The non-woven cloth 4 has its surface applied with sticky material 6 and its sticky surface applied with filtering material 5 such as activated carbon or fragrant material able to give out fragrance or material able to remove bad smell in air, or the like, as shown in FIGS. 5 and 6. Thus, the fan blade in this invention can not only filter dust in air, but produce fragrance as well.

While the preferred embodiment of the invention has been described above, it will be recognized and understood that various modifications may be made therein and the appended claims are intended to cover all such modifications that may fall within the spirit and scope of the invention.

What is claimed is:

1. A fan blade comprising a shaft base and plural wind guiders formed integral with said shaft base, said shaft base bored with a center hole for the spindle of a motor to be inserted therein, said plural wind guiders fixed spaced apart equidistantly on the circumferential edge of said shaft base, each said wind guider formed integral with a netted portion, said netted portion provided with numerous dense net holes, said netted portion formed with a recessed groove in the surface of said wind guider, said recessed groove fixed therein with non-woven cloth, said non-woven cloth having its surface applied with sticky material, said sticky surface of said non-woven cloth applied with filtering material.

2. The fan blade as claimed in claim 1, wherein said net holes could be square-shaped or round-shaped so long as a current of air can pass therethrough.

3. The fan blade as claimed in claim 1, wherein each said wind guider is formed with only one said netted portion.

4. The fan blade as claimed in claim 1, wherein each said wind guider is formed with more than one said netted portion.

5. The fan blade as claimed in claim 1, wherein said net holes of said netted portion are of any shape.

6. The fan blade as claimed in claim 1, wherein said filtering material is activated carbon.

7. The fan blade as claimed in claim 1, wherein said filtering material is fragrant material able to give out fragrance.

8. The fan blade as claimed in claim 1, wherein said filtering material is a material able to remove a bad smell in air.

9. The fan blade as claimed in claim 1, wherein said filtering material is a compound of said activated and fragrant material.

* * * * *